United States Patent [19]

Alfred

[11] Patent Number: 4,984,806

[45] Date of Patent: Jan. 15, 1991

[54] BOARD GAME

[76] Inventor: Steven R. Alfred, Rte. 1, Box 1418, Checotah, Okla. 74426

[21] Appl. No.: 484,980

[22] Filed: Feb. 26, 1990

[51] Int. Cl.[5] ..... A63F 3/00

[52] U.S. Cl. ..... 273/255

[58] Field of Search ..... 273/243, 255, 260, 261, 273/262

[56] References Cited

U.S. PATENT DOCUMENTS

| | | | |
|---|---|---|---|
| 2,105,837 | 1/1938 | Mayer et al. | 273/260 |
| 3,536,328 | 10/1970 | Finerty | 273/243 |
| 3,948,524 | 4/1976 | Ladd et al. | 273/267 |
| 4,139,199 | 2/1979 | Drummond | 273/243 |
| 4,194,741 | 3/1980 | Rea | 273/243 |
| 4,234,186 | 11/1980 | Forrest et al. | 273/243 |
| 4,515,369 | 5/1985 | Johnson | 273/243 |
| 4,902,021 | 2/1990 | Burroughs | 273/260 |
| 4,913,443 | 4/1990 | Currey, Jr. | 273/243 X |

*Primary Examiner*—Edward M. Coven
*Assistant Examiner*—William E. Stoll
*Attorney, Agent, or Firm*—Leon Gilden

[57] ABSTRACT

A board game is set forth utilizing a checkerboard style of opposing playing fields utilizing tokens symbolizing the various playing cards in a conventional deck of cards. Accordingly, twenty-six tokens are afforded each of two opposing players, with the object of the game including opposing players trying to capture an opponent's king token. Each player is provided a pair of dice for imparting an element of chance into the movement of the opposing tokens.

1 Claim, 7 Drawing Sheets

BOARD GAME

BACKGROUND OF THE INVENTION

1. Field of the Invention

The field of invention relates to board games, and more particularly pertains to a new and improved board game wherein tokens symbolizing playing cards are afforded each player with an object to capture or mobilize an opposing king token.

2. Description of the Prior Art

The use of various board games including the employment of playing cards and other board games employing dice have been developed in the prior art. Heretofore, the prior art has not provided a board game of the scope and involvement challenging the strategy and ability of opposing players to effect appropriate moves and counter-moves in relation to one another. For example, U.S. Pat. No. 4,194,741 to Rea provides a board game with a basic checkerboard playing field in contradistinction to the opposing checkerboard playing fields of the instant invention wherein various tokens are utilized to effect jumping and repositioning of the tokens relative to opposing tokens to effect appropriate control an maneuverability within the game.

U.S. Pat. No. 4,515,369 to Johnson provides a board game utilizing the elements of "craps" and "blackjack" into a combined game where the rules of blackjack apply to the movement, but the increment of movement is determined by rolling of the die.

U.S. Pat. No. 4,261,574 to Rogers provides for a board game utilizing opposed checkerboard portions, but is utilized to simulate a space war conflict between opposing players.

U.S. Pat. No. 4,743,029 to Consolatore sets forth a board game wherein seasons and portions of the year are chosen in response to questions provided by cards utilized by the game.

U.S. Pat. No. 4,244,579 to Campos provides a strategy game with dice and cards utilized to effect movement peripherally about the board of the game.

As such, it may be appreciated that there is a continuing need for a new and improved board game which addresses the issues of challenge and interest to opposing players in attempting to effect a victory over the other is provided by the instant invention.

SUMMARY OF THE INVENTION

In view of the foregoing disadvantages inherent in the known types of board games now present in the prior art, the present invention provides a board game wherein the same includes a plurality of opposed matrix squares configured for reception of complementary playing cards, or alternatively tokens, for use by opposing players in a confronting relationship between the players. As such, the general purpose of the present invention, which will be described subsequently in greater detail, is to provide a new and improved board game which has all the advantages of the prior art board games and none of the disadvantages.

To attain this, the board game of the instant invention includes a game board formed with a checkerboard-type pattern of free spaces for movement of the cards or tokens throughout with positioning for two players about a medial dividing portion of the board, with side portions of the board of each player including opposing queen and king rows of squares wherein a rearwardmost square is provided for a respective king and queen playing card or token with forwardly oriented squares comprising dice squares, wherein the object of the game is for opposing players to capture and imprison or remove opposing players from the opposed playing fields of game. Aligned prison squares are provided positioned medially of a rear edge of the game board within each playing field for the imprisoning of opposing playing cards.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved board game which has all the advantages of the prior art board games and none of the disadvantages.

It is another object of the present invention to provide a new and improved board game which may be easily and efficiently manufactured and marketed.

It is a further object of the present invention to provide a new and improved board game which is of a durable and reliable construction.

An even further object of the present invention is to provide a new and improved board game which is susceptible of a low cost of manufacture with regard to both materials and labor, and which accordingly is then susceptible of low prices of sale to the consuming public, thereby making such board games economically available to the buying public.

Still yet another object of the present invention is to provide a new and improved board game which provides in the apparatuses and methods of the prior art some of the advantages thereof, while simultaneously overcoming some of the disadvantages normally associated therewith.

Still another object of the present invention is to provide a new and improved board game wherein the same utilizes playing cards that traverse a playing field and effect removal and capture of opposed playing cards based on predetermined rules.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
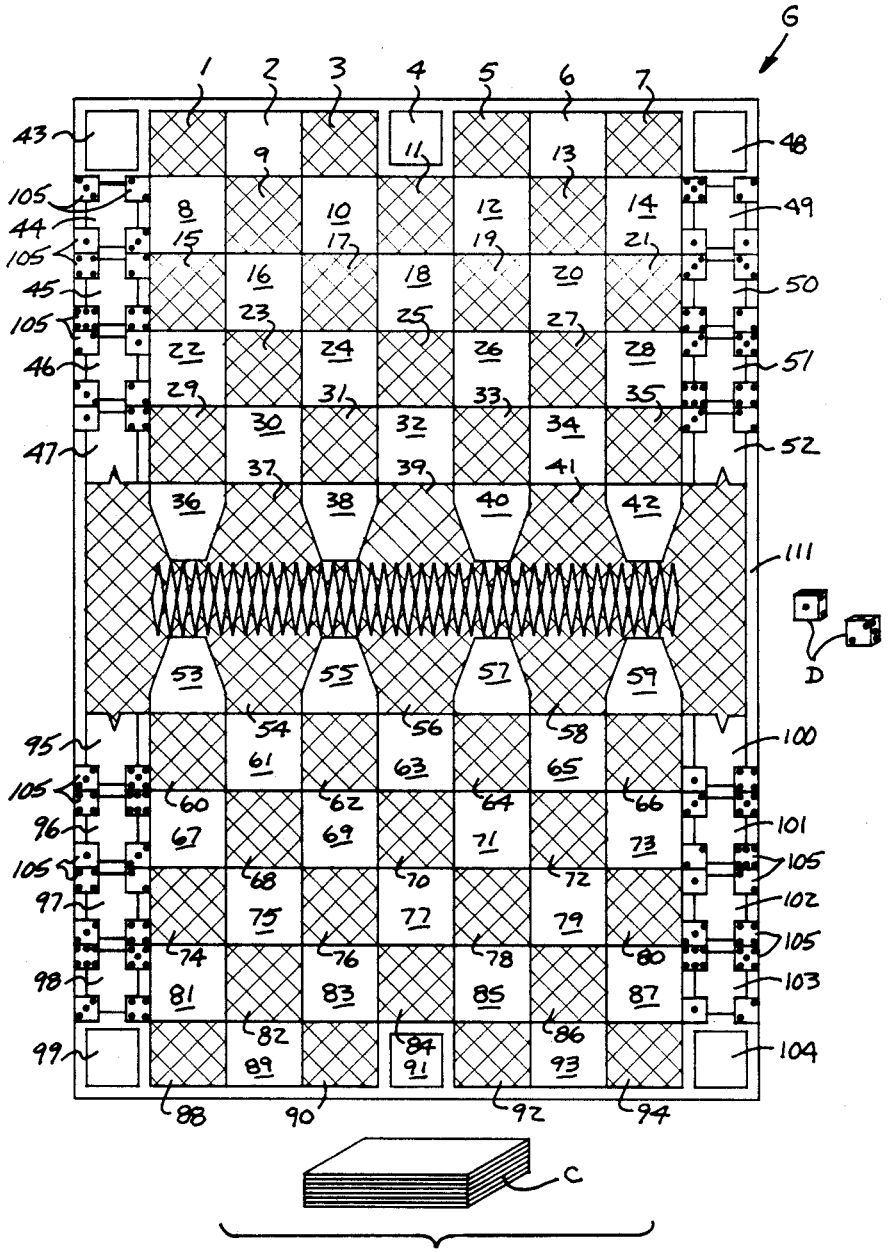
FIG. 1 is a top plan view of the instant invention.
Figure 2:
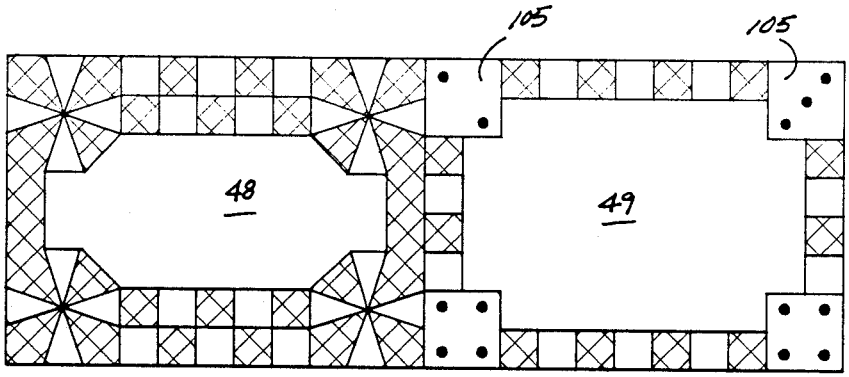
FIG. 2 is a top plan view, somewhat enlarged, of a typical king square and forwardly oriented dice square.

With reference now to the drawings, and in particular to FIGS. 1 to 14 thereof, a new and improved board game embodying the principles and concepts of the present invention and generally designated by the reference designation "G" will be described.

More specifically, the board game "G" of the instant invention essentially comprises a game board including a matrix of spaces or squares for positioning of playing cards thereon. The squares are of a configuration to accommodate a playing card in a conventional fifty-two card deck of playing cards. The playing field of the board game includes squares 1 through 3, and 5 through 42 to define the first open field of squares, with squares 53 through 90 and 92 through 94 defining the second open field of the squares. Squares 4 and 92 define first and second prison squares respectively and are positioned medially of a back row of the respective first and second playing fields. The squares 43 and 48 positioned at opposite corners of the rear row of the first playing field include the first king and queen squares respectively in the squares 43 and 48 with the squares 99 and 104 positioned in the corners of the opposing playing field defining the second queen and king squares respectively. Squares 44 through 47 define the first dice squares oriented in alignment and forwardly of the first king square 43 and define the first king's row, including square 43 through 47. The first queen's row includes squares 48 through 52 including the first queen dice squares 49 through 52. Accordingly, the second queen's row is defined by the squares 95 through 98, with the second queen's row defined by the square 95 through 99, with the second king's row defined by the squares 100 through 104, including the second dice squares 100 through 103. The dice square digit designations 105 are designations of typical dice digits of a predetermined and arbitrary designation. Divider squares 111 coextensively formed along the width of the game board and equally dividing the first and second playing fields are positioned medially therebetween. At least one pair of dice "D" are utilized to effect a chance device and are alternately utilized by the opposing players of the first and second playing fields. Optionally, a second pair of dice could be utilized to enable each player to be provided with an individual dice set or pair. A conventional deck of playing cards "C" is utilized comprising fifty-two cards of conventional club, spade, heart, and diamond configuration, with the numeral designations between 2 and 10 and face cards, including the jack, queen, king, as well as the ace, for each suit of the playing cards defined by the club, spade, heart, and diamond.

Figure 3:
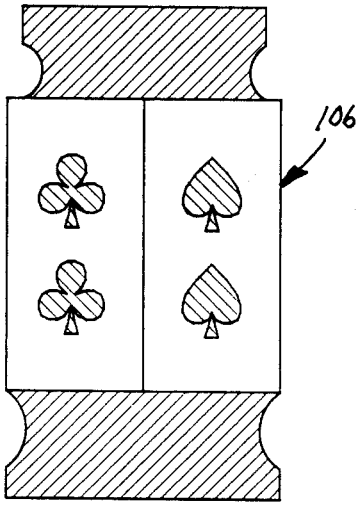
FIG. 3 is an orthographic view taken in elevation of a typical token that may be utilized in the playing of the game, as opposed to playing cards.
Figure 4:
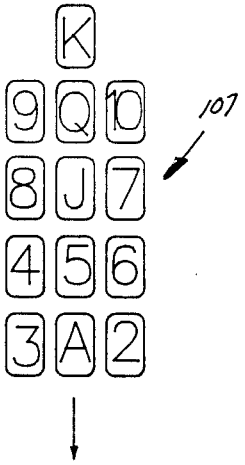
FIGS. 4, 5, 6, and 7 are top plan, diagrammatic views of typical formations utilized in the playing of the board game of the instant invention.
Figure 5:
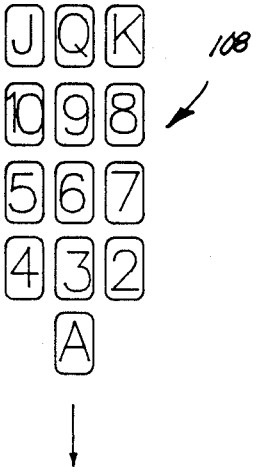
Figure 6:
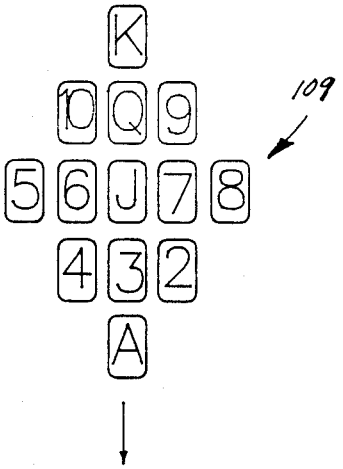
Figure 7:
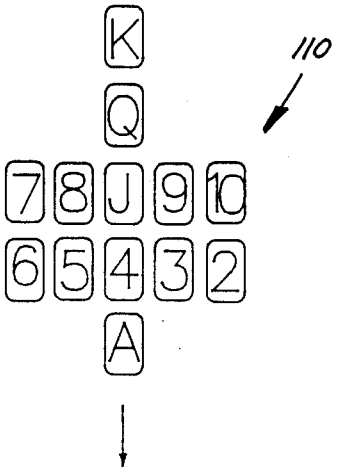

FIG. 3 is illustrative of a token example that may be utilized in lieu of playing cards wherein the token would include a top circular section, a bottom circular section and a mid section with the appropriate designation of the playing card positioned thereon by appropriate symbology, such as a club or spade. Optionally, the token could include registration pieces, such as a projection directed outwardly and upwardly of the top section receivable within a bore of the bottom section to enable the tokens to be stacked on top of one another.

The Rules, Procedures and Definitions in playing Camelot:

Camelot is a game of cards that is played on a game board.

The object of this game is to capture the opponents king, or at least put the opponents in such a position as to force him into surrender.

THE SUIT PICKING PROCEDURE

Out of the four suits in a deck of cards (2 suits which are black, the other two being red) the players will each pick his color.

Having done so each player will decide which suit of the color he picked he will use against his opponents suit. The suit so picked becomes the players army suit.

The result of this being one red army suit opposed to one black army suit.

The suit not chosen as each players army suit becomes that players draw suit.

The draw suit is primarily used to determine which player gets to move his cards.

THE DRAW SUIT PROCESS RULES

Instead of the players moving their cards on only an alternating basis, they must draw a card from their draw suit.

The holder of the high card gets a chance to move the card of his choice on the playing board. While the loser of the draw must leave his cards where they are in the hopes that he will win the next draw from the draw suit cards, thus getting a chance to move the card of his choice.

This process is repeated until each player's draw suit is used up. Then the players each will reshuffle all of his draw suit cards and begin again.

Should at any time the players draw the same card, neither player gets to move. They must draw again. The winner of this draw gets 2 moves in a row against his opponent.

However, should they draw two cards of the same value again, neither player gets to move. They each must draw again. The winner of this third draw gets 3 moves (in a row) against his opponent.

THE DRAW SUIT PROCESS RULES

If by chance they draw two cards of the same value again, neither player gets to move. This fourth drawing is discounted. Each player must reshuffle all of their draw suit cards. This is done in order to get a fresh start on the draw suit process.

THE RULES FOR PLACING THE CARDS ON THE PLAYING BOARD

Each player will shuffle his draw suit.

Each player draws the top card (always the top card) from his draw suit. Unfortunately the winner of this draw (the holder of the high card) must pick his attack pattern first.

Attack pattern: The way in which every card in each player's army suit is placed on the open field section of the playing board. Red army suit to the red side. Black army suit to the black side.

After the first attack pattern has been picked and laid down on the playing board, each player will draw from his draw suit again.

If the player who won the first draw wins again, his opponent must duplicate the attack pattern already laid down on the playing board.

However, if the first draw winner looses his opponent can pick his own and or different attack pattern.

Illustrated in FIGS. 4–7 formations 107–110 respectively are 4 such attack patterns. Notice that each one has its ace to the front and center with the smaller non-face cards to the front and the face cards towards the back.

Once both attack patterns have been picked and laid down on the playing board, each player must reshuffle all his draw suit cards once again before starting the game.

RULES FOR MOVES WITHIN THE OPEN FIELD SQUARES

There are basically 3 groups of cards in a given suit, and these are the ace, the non-face cards, and the face cards.

Each of these groups can move on the game board only in certain directions while attacking or retreating.

THE ACE: On attack; straight forward and/or diagonal left or right. On retreat; straight back only.

THE NON-FACE CARD: On attack; straight forward and to the left or right sideways; on retreat, straight back and to the left or right sideways.

THE FACE CARDS: On attack; straight forward and to the left or right sideways. On retreat; straight back only.

There is no jumping of one card over another card in any direction.

No card of a given army suit can retreat back over any card of the same suit. This is to say that one should not run over his own cards or men while retreating.

If this is done the card or cards so run over are to be cast out of the game and cannot again be used by either player of the game.

While on the open field section of the game board the king and queen cards can double up and move the as one card. This is done mainly for protection and/or escape from the opponents ace.

THE RULES FOR THE TAKING OF CARDS OR MEN

THE ACE: This card can take any other card, except another ace which it can only deadlock.

THE NON-FACE CARD: The cards are in effect the kings men. Any non-face card of a higher number can take a non-face card of a lower number.

Any 2 non-face cards being across the center battle line square can (move by move) double up to take an opponents non-face cards.

That is to say, one non-face card occupies the same square as another non-face card. One card being on top of the other thus their total number being higher than the opponents single card.

While any 2 non-face cards are doubled up they can attack together, but they must retreat one at a time, move by move, not together.

NOTE: Not only can this doubling up be used as a means to take an opponents cards or men, it can also be used as a way to protect ones non-face cards that are deep into the opponents territory. Protect them at least from the opponents non-face cards whose numbers are lower than the doubled up non-face cards.

Any face card can take any combination of doubled up non-face cards.

Also, any 2 doubled up non-face cards can be taken by a single non-face card provided if, and only if, the single card has a higher number than the 2 doubled up ones.

There can be no higher combinations of non-face cards than doubles.

Furthermore, while one is on his own territory, he cannot double up his non-face cards. He must be past the center battle line squares to do this, or in the opponents territory, in other words.

Any non-face card of a given number meeting another non-face card of the same number, puts these two cards in deadlock.

Any time a non-face card takes another non-face card the card taken is considered captured and is sent to prison.

THE FACE CARDS

These cards can take any non-face cards.

A face card of a higher rank can take a face card of a lower rank.

However, when a face card of a given rank meets another face card of the same rank, these two cards are in deadlock.

Anytime a face card takes a non-face card, that non-face card is considered dead, and out of the game for good.

Any time a face card takes another face card, the card taken is considered captured, and is sent to prison.

However, should the taker wish it, he can execute the captured face card at any time he wins (from the draw) a turn to move.

This option for execution remains his so long as the captured card remains in his prison.

Once a face card has been executed it is out of the game for good.

NOTE; THE RULE FOR THE PRISON SQUARES WILL BE EXPLAINED AT A LATER POINT WITHIN THE CAMELOT GAME RULES BOOK.

As mentioned above in each set of rules for each group of cards, anytime any two cards of equal value meet each other head on a deadlock is the result.

And anytime any two cards are deadlocked, they cannot be used until the deadlock is broken.

A deadlock can be broken in one of two ways, depending of course on which two cards are involved in the deadlock.

Either card can retreat, or either card an attack, provided, the third way can be used.

A third way to break a deadlock, if non-face cards are involved, is doubling up, which must be done in accordance with the rules so far set forth.

No card can take any other card from the side whether they be on the open field section of the game board, the dice squares, or the kings or queens castles.

THE TAKING OF CARDS OR MEN

All cards must take their opponents cards straight on.

The exception to this is the ace. This card can (in addition to the above rule) take any card, except another ace, on a diagonal forward move left or right.

On retreat a card of a given higher number or rank can take another card of a lower number or rank provided that card is in the path of the retreating cards. This is to say that one can on retreat take his opponents card or cards if they are of a lower number or rank than the card in retreat.

The game is won and therefore over when a player succeeds in placing his ace in the opponents kings castle square and his king in the opponents queens castle square.

Also if a player's king and queen cards are overtaken and therefore defeated by his opponents all powerful ace on the open field section of the game board, the game is likewise over.

THE KINGS AND QUEENS CASTLES AND THEIR DICE SQUARES

The kings and queens castles are located on the furthermost upper and lower corners of either end of the playing board.

There are 2 castles for the black side of the playing board and 2 castles for the red side.

On the black side of the playing board the kings castle is in the lower left hand corner while the queens castle is in the lower right hand corner.

Just the reverse is true for the locations of the kings and queens castles on the red side of the playing board.

These castles serve the purpose of being the only real protection a king or queen has against their opponents all powerful ace.

For once a king or queen is in their castle they cannot be taken by the ace. That is to say, they cannot be taken in the usual manner.

However, the rules for taking of the king or queen in their castles will subsequently be discussed.

Note: A king or queen taking refuge in their castle are termed encastled king or encastled queen.

Figure 8:
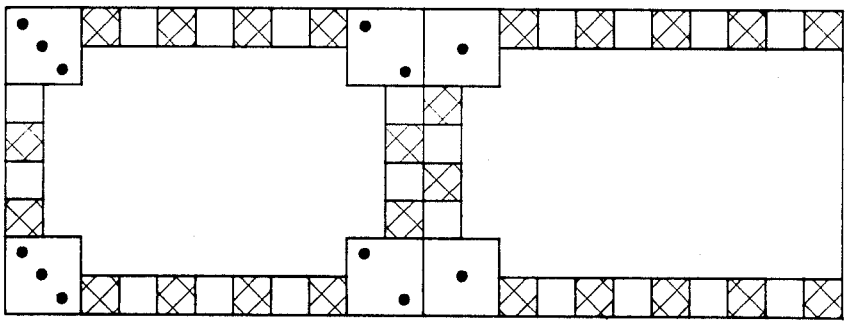
FIG. 8 is a top plan view of a plurality of aligned dice squares utilized in the instant invention of typical configuration.

As one will note each of these castles are preceded by a horizontal row of 4 dice squares in front of them of a configuration illustrated FIG. 8.

These squares are called dice squares and each square is assigned a number.

The dice square closest to the kings or queens castle being number 1. The next one out being number 2, and so on to 4. The actual purpose of these dice square numbers will be further explained later on. The first 3 dice squares preceding each castle have a dotted dice figure in each of their 4 corners respectively. The last of these squares having only 2 dotted dice figures present within its boundaries.

Note: The 4 dice squares plus the kings castle equal the kings row. Likewise the 4 dice squares plus the queens castle equal the queens row.

THE KINGS AND QUEENS CASTLES AND THEIR DICE SQUARES

These red and black squares form the boundary line between the dice square and the open field section of the playing board.

Note: The term open field is and has been used to describe that part of the playing board in which the normal rules for card movement apply.

However, the kings and queens rows have a somewhat different set of card movement rules.

MOVES INTO, OUT OF, AND WITHIN THE KINGS AND QUEENS ROWS

Figure 9:
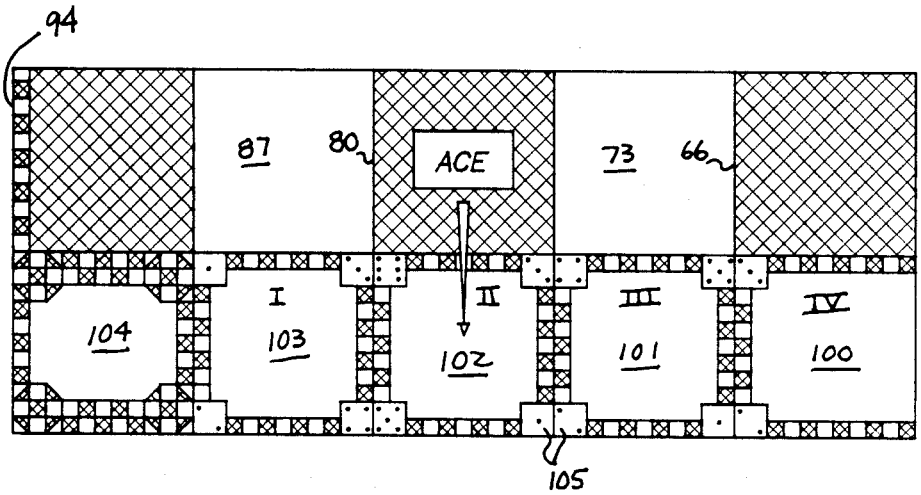
FIG. 9 is a top plan view of a playing card entering dice square of a king's row.

First one must have a card along side the dice square he wishes to move into (FIG. 9 for example).

When one wins another chance to move he cannot simply move his card into the dice square.

The player must first roll the dice. If he rolls 2 numbers which match any 2 of the 4 dotted dice figures present within the dice square, his card is along side. Then and only then can he move his card into that dice square.

Ace moves into dice square 102 from the open field.

Those dotted dice figures needed for entry are shown shaded in green. If any 2 of these 4 dotted dice figures are rolled, in goes the ace.

However once in a dice square, one cannot simply move out of it and onto the open field.

One must first, after winning a move, roll the dice. If he rolls 2 numbers which match the 2 dotted dice figures on the open field side of the dice square, he can then move out of that dice square.

MOVES INTO, OUT OF, AND WITHIN THE KINGS AND QUEENS ROWS

Figure 10:
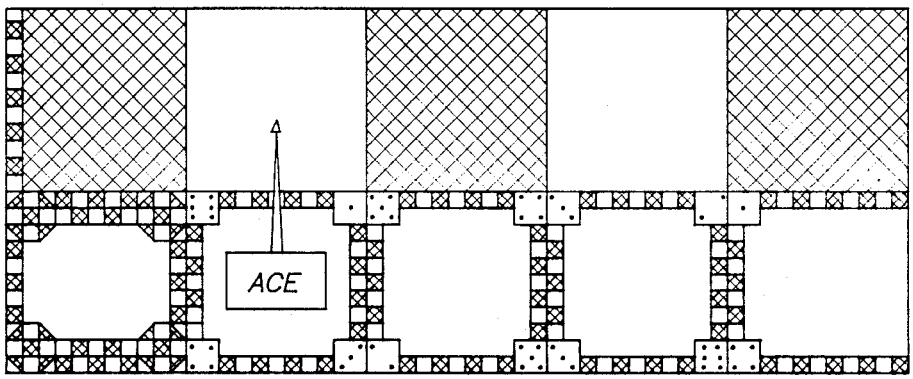
FIG. 10 is a top plan view of a playing card exiting a dice square of a king's row.

The ace may proceed out of dice square 1 and onto open field (FIG. 10).

Being in a dice square and wishing to move into another dice square, either in front of or behind the occupied dice square, means a roll of the dice is once again necessary.

Only this time the numbers rolled must match any 2 of the 4 dotted dice figures present, back to back, between the occupied dice square and the dice square in front of it.

Figure 11:
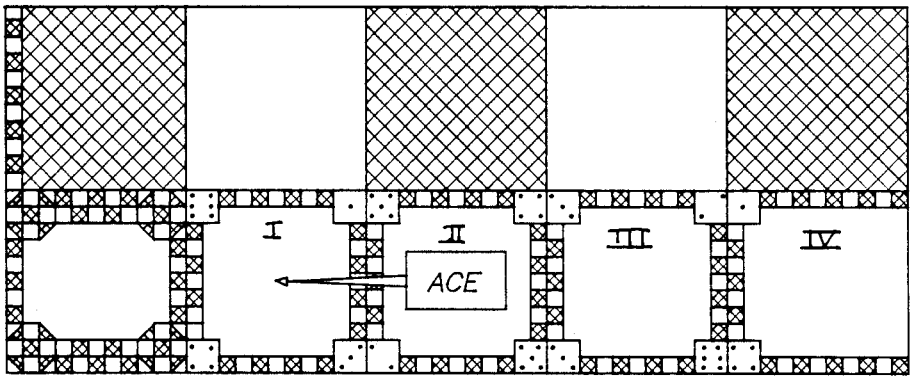
FIG. 11 is a top plan view of playing card traversing a plurality of dice squares within a king's row.

The ace must move out of one dice square and into another dice square, a forward move, as illustrated in FIG. 11.

If a backward move is desired, the numbers rolled must match any 2 of the 4 dotted dice figures present, back to back, between the occupied dice square and the dice square behind it.

MOVES INTO, OUT OF, AND WITHIN THE KINGS AND QUEENS ROWS

Figure 12:
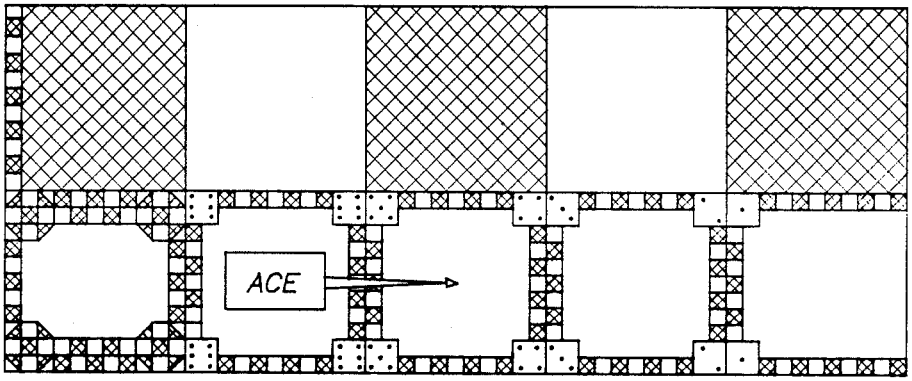
FIG. 12 is a top plan view of a further example of a playing card in movement within a plurality of aligned dice squares.

The ace moves out of one dice square and into another dice square, a backward move, exemplified in FIG. 12.

It should be noted here that any card in the dice square adjacent to the kings or queens castle must roll the 2 numbers which will match the dotted dice figures closest still yet to the castle square.

Figure 13:
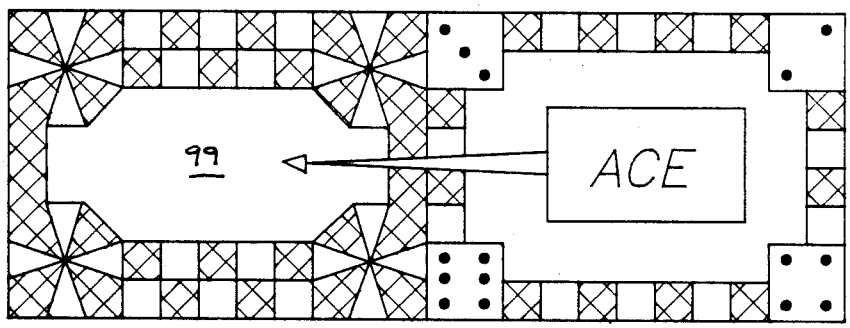
FIG. 13 is a top plan view, somewhat enlarged, of a playing card entering a queen's square.
Figure 14:
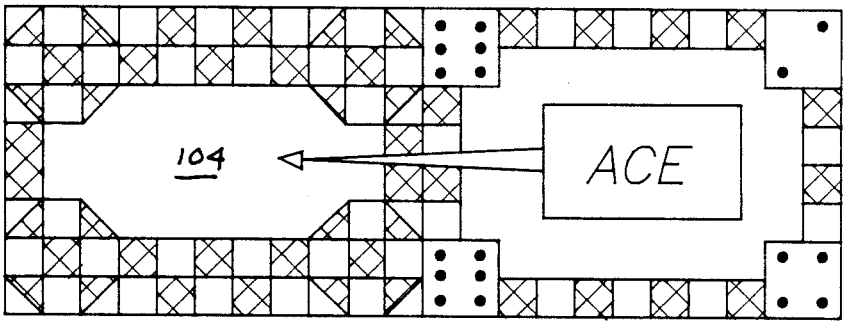
FIG. 14 is a top plan view of a playing card entering a king's square.

The ace may proceed into kings and queens castles as illustrated in FIGS. 14 and 13.

If the ace or any other card in a castle square needs to move back through the dice squares, the double 6 numbers (for dice square 1 of the kings row) or the 3–6 numbers (for dice square 1 of the queens row) must be rolled before such a move can be made.

The ace was used in the previous dice square movement illustrations for reasons of explanation of the following kings and queens row card movement rules.

MOVES INTO, OUT OF, AND WITHIN THE KINGS AND QUEENS ROWS

As set forth earlier within the open field card movement rules the ace had the sole power to move and take other cards diagonally.

However, an ace going into, through or out of the kings or queens rows cannot at anytime move diagonally.

It must move as all other cards do in these rows. And that is, straight forward or backwards, straight in or straight out.

Remember, as stated much earlier, no card can take another card from the side.

So the ace, the only card which can defeat the king, having now lost its ability to move diagonally into or out of the kings or queens rows is forced to use the dice squares as its only means to take an encastled king or queen.

It should be noted here that no roll of the dice is necessary for a card, any card, to enter into a kings or queens castle from the open field square next to it. Likewise no roll of the dice is necessary for a card, any card, to move sideways onto the open field from a kings or queens castle square.

Because of the ease at which any card can enter into a kings or queens castle square, these squares must be protected. That is, protected from entry into by other cards on the open field, as well as from the dice squares.

The king and queen cards are the ones best suited to protect their castles, being closest to them.

Indeed, for protection of the castles is the second most important reason why the kings and queen cards are placed further back on the playing board then any of the other cards.

Any castle square which has a card from the opposing side on it, is said to be occupied and unfortunately an occupied castle square cannot be used by either the king or queen for protection against the ace.

Before an occupied castle square can be used by the king or queen cards, the occupying card must be routed out by a card of higher rank or number.

Since no card can be taken from the side, one is forced to use the dice squares in an effort to route the occupying card. Just as the ace would in trying to capture an encastled king or queen.

Where as the king and queen can both, if necessary, occupy the kings castle at the same time, only the queen or king, one at a time not together, can occupy the queens castle.

Also, when a king and queen are in the kings castle together and it becomes necessary for them to flee, they must do so one at a time, not together.

It should be noted at this point that the dice squares carrying the number 4 or IV in any kings or queens row need not have a roll of the dice for entry into or exit from them.

However, movement into the next dice square must follow the rules already laid down.

THE DICE SQUARE NUMBERS

The term required number or combination of numbers refers to the dice square figures of each dice square.

THE DICE SQUARE NUMBERS

As one noted earlier each dice square has an assigned number.

The actual purpose of these numbers has to do with the number of dice rolls one gets while on that square thus increasing his chances of movement (whatever the direction) within the dice squares or out of them as well.

This is because the dice square carrying the number 4 gives one 4 chances to get the required 2 numbers needed for advancement into the next dice square.

Provided if and only if upon each consecutive dice roll only 1 of the required numbers is rolled. For each time one uses one of his dice roll chances and gets only 1 of the required 2 numbers, he may roll again in an effort to get the 2 required numbers on the same roll. This is done until all of the possible and additional dice roll chances are used up.

However, if one fails to roll the 2 required numbers and does not even roll just one of the required numbers, he loses all his other still yet unused dice roll chances as well as his chance to move his card into the dice square he wanted to put it in.

Furthermore there is no adding up or saving over of these single required numbers rolled one at a time. One must get the needed 2 numbers for advancement on the same roll of the dice in order to advance his card.

Also there is no carrying over of any unused dice roll chances to the next dice square.

Likewise (but only in accordance with the rules so far set forth) the dice square carrying the number 3 gives one 3 possible and additional dice rolls and so on down to square 1 which gives one only 1 possible and additional dice roll after the first allowed dice roll.

It should be noted here that failure to roll the right combination of numbers for any move into, through, or out of the kings or queens rows does not cost one his chance to move a card of his choice on the open field.

Actually, with each dice square there is a first or allowed dice roll after which the number of possible dice rolls is determined by the dice square number itself. However, as stated earlier, failure to roll at least one of the required dice square figure numbers will cost one all unused dice roll chances.

THE PRISON SQUARES

These squares are located one at each end of the playing board exactly between the kings and queens castle squares.

Each time a players card is captured it is sent to the opponents prison square where it is usually guarded by a single card.

In order to guard a prison square safely one need only to place a card in front of the square whether there be 1 to 7 or more cards on a prison square only one card is needed to prevent their escape.

However, that one card must have a rank or number equal to or higher than any single card that is on the prison square.

While on a prison square non-face cards loose their ability to double up. Furthermore, when non-face and face cards are in prison they forfeit their ability to move sideways and can by no means move backwards thus to escape a card can only move straight forward and since the card guarding the prison square has a value equal to or greater than the highest ranked or numbered card in prison, no escape is possible.

Unless of course the card guarding the prison square is itself taken by an opponents card of still yet higher rank or number.

Note: So that all non-face cards captured and sent to prison will pose no threat to the card left guarding the prison square, the jack face card is usually used. This also has the effect of forcing ones opponent to send in a card of higher rank than the jack to free his imprisoned cards.

It should be noted here that it is up to each player who has a prison square full of cards to keep them in a diminishing order. That is, the card with the highest rank or number must always be kept on top of the other cards of lower rank or number. And so on down through the pile of imprisoned cards to the bottom-most and lowest numbered card so each time a player captures one of his opponents cards he must put in its proper place within the pile of imprisoned cards.

THE PRISON SQUARES

No card can enter a prison square for protection nor can any card move across a prison square while retreating or attacking.

Should one succeed in taking the card guarding the opponents prison square the way is then clear for his imprisoned cards to escape, but they must do so in accordance with the following rules:

After a card guarding a prison square has been taken neither player can move his cards on the game board. At least not until the taker of the card rolls the dice.

If he rolls 2 numbers which total to an even number exactly one half of this even number is used to determine the number of cards that may be allowed out of prison.

If he rolls 2 numbers which total to an odd number the highest number of the two rolled determines the number of cards to be let out of prison.

Once these cards are free they are sent back across the center battle line where they are placed in any order the opponent wishes to put them.

Only now can the game resume and/or proceed in the normal manner.

It should be noted here that if a prison square is left unguarded all one needs to do (in order to free his cards) is to use his chance to move a card on one (and only one at a time) of his imprisoned cards.

The only way one can stop his opponent from freeing any more of his cards is to place another card in front of the prison square.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A game board having a top surface divided by indicia into squares, said squares being arranged in a grid matrix formed by a plurality of rows extending between two opposite sides of the game board and columns extending between two opposite ends of the game board defining an upper end and a lower end, the game board oriented such that a first and second player will respectively assume positions adjacent the opposite ends of the game board, and the board divided medially between the upper end and the lower end by a single row of divider squares extending between opposite sides of the game board defining an upper playing field and a lower playing field of the first and second player respectively, and a column of squares adjacent the opposite sides of the game board defined by non-playing field squares, the rows and columns oriented between the first and second non-playing field squares defined by playing field squares to require a player movement and strategy about the non-field squares within the playing field squares, and a deck of playing card means for division equally between the first and second players with the playing card means including playing cards for use as tokens for positioning and movement throughout the playing field and non-playing field squares, and a plurality of chance controlled members for directing movement of the tokens, each chance controlled member defined by a dice including an indicia thereon, the indicia designated 1–6 corresponding to 6 faces of each dice, and wherein each row of squares adjacent each end of the game board includes a prison square within the playing field squares for temporary storage of playing cards of an opposing player therein, and wherein the playing card means is defined by fifty-two cards divided equally into four suits defined by a heart suit, a club suit, a spade suit, and a diamond suit, and wherein each column of non-playing field squares includes a castle square positioned adjacent respective ends of the game board, and the squares within the column of non-playing field squares oriented forwardly of the castle squares are each defined by dice squares, the dice squares including dice digital designations positioned at corners of each dice square for indication of digital designations to be obtained by the chance members to enable access within the dice squares by opposing players.

* * * * *